US005513270A

United States Patent [19]

Lewis

[11] Patent Number: 5,513,270

[45] Date of Patent: Apr. 30, 1996

[54] SPEAKER BOX

[76] Inventor: Leopold A. Lewis, 50 Abingdon Drive, Nepean, Canada, K2H 7M7

[21] Appl. No.: 193,015

[22] PCT Filed: Aug. 12, 1992

[86] PCT No.: PCT/CA92/00340

§ 371 Date: Feb. 7, 1994

§ 102(e) Date: Feb. 7, 1994

[87] PCT Pub. No.: WO93/04564

PCT Pub. Date: Mar. 4, 1993

[30] Foreign Application Priority Data

Aug. 12, 1991 [CA] Canada ..... 2048954

[51] Int. Cl.[6] ..... H04R 25/00

[52] U.S. Cl. ..... 381/154; 381/159; 181/160

[58] Field of Search ..... 381/188, 205, 381/88, 90, 24, 154, 159, 158; 181/156, 199, 160, 144, 145, 147, 146, 151, 152

[56] References Cited

U.S. PATENT DOCUMENTS

| | | | |
|---|---|---|---|
| 2,852,087 | 9/1958 | Ruschhaupt | 181/151 |
| 2,926,740 | 3/1960 | Holland | 181/151 |
| 4,730,694 | 3/1988 | Albarino | 381/156 |
| 5,150,417 | 9/1992 | Stahl | 381/159 |
| 5,170,436 | 12/1992 | Powell | 381/188 |

OTHER PUBLICATIONS

Listening Tests–Turning Opinion into Fact Floyd E. Tools.
Loudspeakers in Vented Boxes: Part I, A. N. Theile.
Loudspeakers in Vented Boxes: Part II, A. N. Theile.
Direct–Radiator Loudspeaker System Analysis, Richard H. Small.
Vented–Box Loudspeaker Systems–Part I: Small–Signal Analysis, Richard H. Small.
Vented–Box Loudspeaker Systems Part II: Large–Signal Analysis, Richard H. Small.
Vented–Box Loudspeaker Systems Part III: Synthesis, Richard H. Small.
Simplified Loudspeaker Measurements at Low Frequencies, Richard H. Small.
Sensitivity of Thiel's Vented Loudspeaker Enclosure Alignments to Parameter Variations, D. B. Keele, Jr.
Acoustic Field in an Enclosure and Its Effect on Sound–Pressure Responses of a Loudspeaker, Shinichi Sakai.
Optimum Loudspeaker Placement Near Reflecting Planes, K. O. Ballagh.
Radiation from a Dome, James M. Kates.
Peak Current Requirement of Commercial Loudspeaker System, Matti Otala and Pertti Huttunen.
Active and Passive Filters as Loudspeaker Crossover Networks, J. Robert Ashley and Allan L. Kaminsky.
Constant–Voltage Crossover Network Design, Richard H. Small.
Dividing Networks for Loud Speaker Systems, John K. Hilliard and H. R. Kimball.
Optinum Passive Loudspeaker Dividing Networks, A. N. Thiele.
Computer–Aided Design of Loudspeaker Crossover Networks, G. J. Adams and S. P. Roe.
Impedance matching: a brief review, C. Bowick.
Another Look at Crossover Networks, N. Thiele.

*Primary Examiner*—Curtis Kuntz
*Assistant Examiner*—Huyen D. Le
*Attorney, Agent, or Firm*—Biebel & French

[57] ABSTRACT

This invention relates generally to vented loudspeakers for the reproduction of musical sounds, but particularly to the design and location of ports or vents that tune the enclosure. The loudspeaker system has an enclosure, having a front baffle and a pair of loudspeaker drivers mounted in the baffle. The enclosure has a hexagonal cross-section. A pair of vents are each located at a juncture of the vertical side edges of the front baffle and its adjoining panels. The vents lead into the enclosure via a conduit, which ends in an inlet. The inlet is positioned within the enclosure to face the rear of the loudspeaker driver. By this arrangement high to mid frequency sound waves radiated within the boundaries of the enclosure and entering the inlet are substantially attenuated in the conduit and low frequency sound waves radiated within the boundaries of the enclosure are reinforced with sound waves directly radiated from the front of the loudspeaker driver.

24 Claims, 5 Drawing Sheets

SPEAKER BOX

FIELD OF THE INVENTION

This invention relates generally to a vented loudspeaker system for the reproduction of musical sounds, and particularly to a two-way loudspeaker configuration.

BACKGROUND OF THE INVENTION

Procedures for the alignment of vented loudspeakers, utilizing standard formulae for cabinet tuning, have been thoroughly expounded by A. N. Thiele and Richard H. Small. However, interest in the dynamic conditions inside the enclosure remains high, and has led to innovative vent designs and the development of techniques for modifying the environment within loudspeaker cabinets to alter their effective sizes.

The Venturi Vent design comes readily to mind, but perhaps a better know example is the Isobaric System in which one driver, located deep inside the enclosure, creates the acoustic environment for a second, external driver that radiates the sound. Needless to add, this latter example seems wasteful of driving units.

Since the pressure distribution inside a loudspeaker enclosure becomes increasingly nonuniform above 50 Hz (Small, 1971), in the dynamic state in which a wide band of audio frequencies is being reproduced, there already exists, within the enclosure, conditions that allow for optimizing the low frequency performance of the system through careful design and placement of the vent or vents. In this regard the relationship between vent terminations and the pressure distribution inside loudspeaker enclosures remains to be fully explored. For example, vent termination away from high pressure areas and towards areas of relatively more rarefied air should have the effect of tuning a relatively larger box, and vice versa. In such cases, standard formulae for tuning, based on the principles of the Helmholtz resonator, are likely to yield results that require modification by a correction factor to optimize performance.

Furthermore, although the use of absorbent materials to change conditions in closed-box systems has been thoroughly discussed (Moir, 1962) and (Small, 1971), the application of such materials to modify the behaviour of the air mass in a vented system, and thereby vary the tuning, has received far less attention. This latter concept, however, is fully embraced in the present invention.

It is well known that the pressure distribution inside a loudspeaker enclosure is uniform below approximately 50 Hz but becomes increasingly non-uniform above that frequency. Intuitively, one senses that this could influence the techniques employed in the tuning of vented systems. Yet, surprisingly little has been said concerning the possibility of exploiting this phenomenon of pressure distribution by using vent size and placement to optimize performance at low frequencies. An important design consideration would be to avoid the restrictiveness of high pressure areas in the placement of vents; or to state the converse, the benefits of rarefication for simulating a larger enclosure should be investigated.

To pursue this line of reasoning further, it is to be noted that although pressure inside an enclosure is uniform below 50 Hz, or at frequencies where most vented enclosures would normally be tuned, in the strictest of senses this state can only exist in a bandwidth sweep. In reality, many different frequencies are present at once in the reproduction of musical sounds, and forces tending towards pressure uniformity and non-uniformity occur simultaneously. Small observed that pressures tend to be higher than average near the back panel(s) and lower than average near the driver(s). He implied that pressure changes near the geometrical center of the enclosure are less extreme.

Other background an which can be regarded as useful includes U.S. Pat. document No. US-A-4 837 839. This patent describes a compact speaker assembly with an improved low frequency response. This patent merely discloses a speaker as opposed to a speaker system which is the subject of the present invention. In this patent, a speaker transducer assembly is described which is comprised of a pair of speaker diaphragms superimposed on each other and separated by a intermediate partition or baffle. The spaces between the speaker diaphragms and the partition are vented to the outside of the speaker frame by suitable vent openings. This transducer is designed for use generally in motor vehicles or for use in a non-enclosure type mounting.

SUMMARY OF THE INVENTION

A primary object of the present invention is to exploit more fully the dynamic conditions inside the enclosure that can help to improve the quality of reproduced sound at the lower frequencies which, for the purpose of the present disclosure, are defined as frequencies between 40 Hz and 250 Hz.

A second object is to contain distortion-causing back waves in the midfrequencies that normally emanate from conventional vents.

A third object is to develop an enclosure shape that would avoid the degradation of the reproduced sound by standing waves inside, and diffraction outside the enclosure.

A fourth object of this invention is to employ a particular baffle configuration that would enhance off-axis stereo imaging.

Yet another object is to provide a loudspeaker system of superior sonic quality over the entire frequency range for which it is designed, that is to say, from approximately 40 Hz to 20 kHz.

The present invention seeks to provide a vented loudspeaker for reproducing musical sounds and in particular to providing a vented two-way loudspeaker system.

In accordance with this invention, there is provided a loudspeaker system comprising;

an enclosure means having a front baffle for receiving and supporting a driver therein; and vent means in the enclosure, the vent means including an inlet leading into the enclosure and directed to the rear of the driver, an outlet leading outside the boundaries of the enclosure, and a conduit connecting the inlet to the outlet, the vent means selectively positioned and arranged in the enclosure wherein high to mid frequency sound waves radiated within the boundaries of the enclosure and entering the inlet are substantially attenuated in the conduit and low frequency sound waves radiated within the boundaries of the enclosure are reinforced.

BRIEF DESCRIPTION OF THE DRAWINGS

A better understanding of the invention will be obtained by reference to the detailed description below in connection with the following drawings in which:

FIG. 1(*b*) is an isometric view of a speaker stand;

FIG. 4(*b*) is an isometric view of an absorber according to the invention;

DETAILED DESCRIPTION OF A PREFERRED EMBODIMENT

Figure 1:
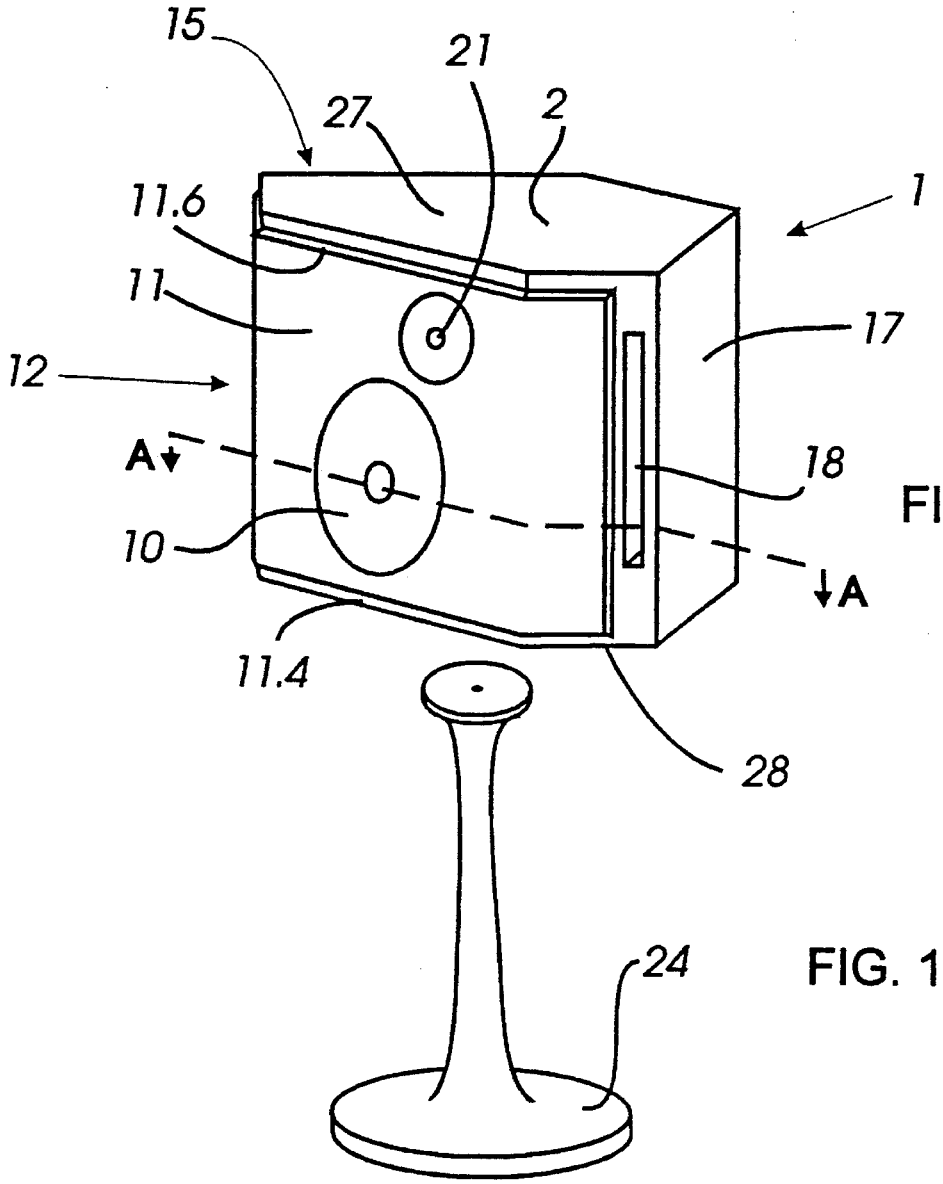
FIG. 1(*a*) is an isometric view of the speaker system according to the invention.

Referring to FIG. 1(*a*), an improved two-way loudspeaker system for the reproduction of musical sounds, especially in the stereo format, is indicated generally by numeral 1. A left hand unit of a stereo pair is shown having an enclosure 2 whose cross section describes an irregular hexagon, and has a top and bottom panel 27 and 28 respectively. The enclosure 2 is further defined by a front baffle panel 11 which supports a low frequency driver or woofer 10, and a high frequency driver or tweeter 21. The enclosure is further defined by a pair of major panels 15 and 17. A pair of vents or ducts 12 and 18 are each positioned at a juncture between the major panels 15 and 17 and the front baffle 11. The vents 12 and 18 lead into the enclosure 2. The rear of the enclosure is formed by a panel 16 extending between the major panels 15 and 17. A stand 24 for the enclosure 2 is shown in FIG. 1(*b*).

The top and bottom panels 27 and 28 are arranged parallel to each other and are made of dissimilar materials.

Figure 2:
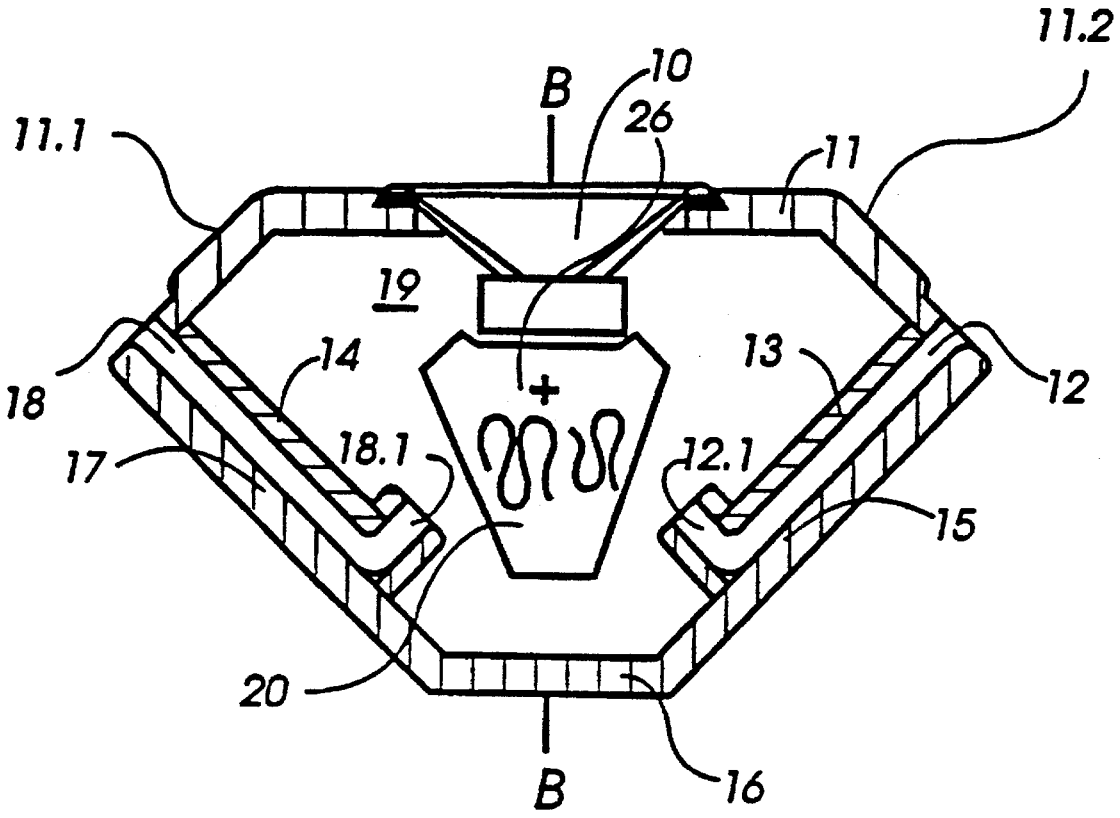
FIG. 2 is a transverse sectional view along a line A—A of the embodiment in FIG. 1(*a*)

Turning to FIG. 2, it may be seen that the baffle panel 11 consists of a main front panel, with two narrow extensions 11.1 and 11.2 receding at 45° on either side of the front panel. These extension panels 11.1 and 11.2 are fastened to the main panel with a high quality adhesive, such as Lepage's "Sure Grip"™ adhesive, to form a single, integrated unit. The entire baffle panel 11, whose edges are all rounded, projects about 7 millimeters from the edges of the enclosure 2. Referring back to FIG. 1, it can be seen that the tweeter 21 and the woofer 10 are aligned in an inclined configuration on the main baffle panel 11. In a stereo pair, the inclination will be in an opposite direction for a fight hand unit (not shown).

A unique feature of the invention is the pair of vents or ducts 12, 18 whose outside outlet ends terminate near the juncture of the vertical side edges of the baffle extensions, 11.1 and 11.2, and the major panels 15 and 17. The greater proportion of each vent is integrated with the respective major panel 15 or 17 of enclosure 11, thereby stiffening the panels, while the smaller proportion is angled inward at 90° to form a free-standing section 12.1, 18.1, each aimed approximately towards a vertical central axis 26 of the enclosure.

The vents are further defined by vent panels 13, 14 which are parallel to the major panels 15, 17, to which the entire vent assemblies are permanently attached to form a rigid vent-panel structure, linked by the rear panel 16.

The woofer 10 and vent inlet openings 12.1, 18.1 form a triangular arrangement about the major central portion of the air mass 19 inside the enclosure. The vents therefore "fire" away from the interior of the major panels 15 and 17 and approximately towards the vertical axis 26 of the enclosure. Absorbent material 20 is installed in a columnar arrangement between the top and bottom panels 27 and 28 and in a region of the vertical axis 26. Smaller pieces of absorbent material 25 are disposed horizontally approximately midway along the vertical dimension of the enclosure, without obstructing the openings of the vents 12.1, 18.1. The structure of the absorbent material 20 may be more clearly seen by referring to FIG. 4(*b*).

Figure 4:
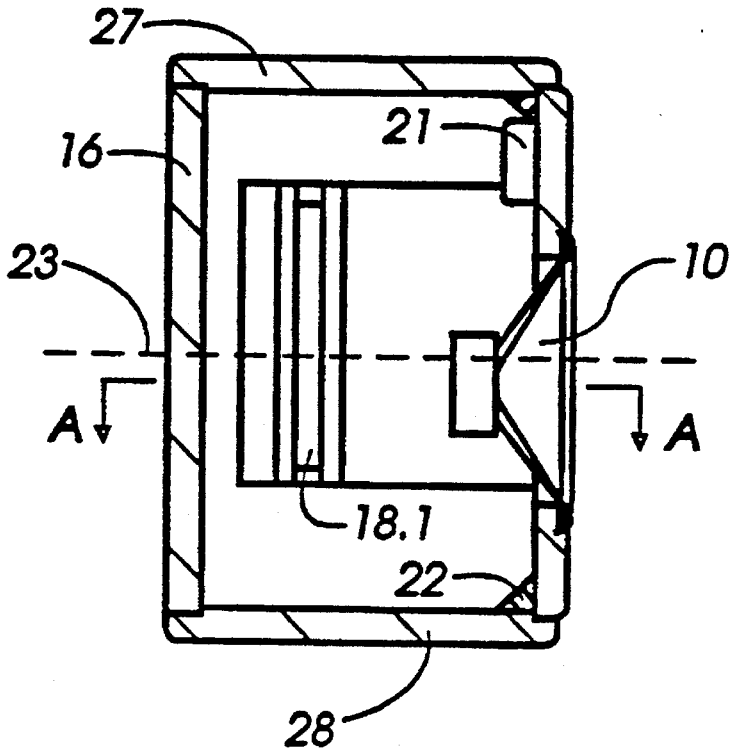
FIG. 4(*a*) is a longitudinal sectional view along a line B—B of FIG. 2.
Figure 4:
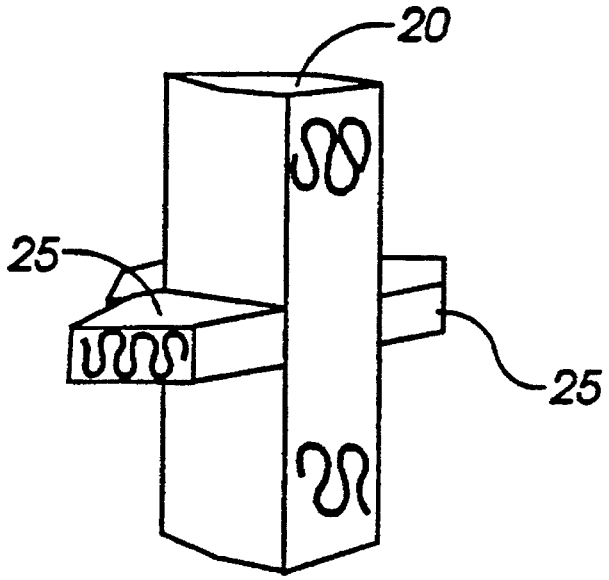
Figure 5:
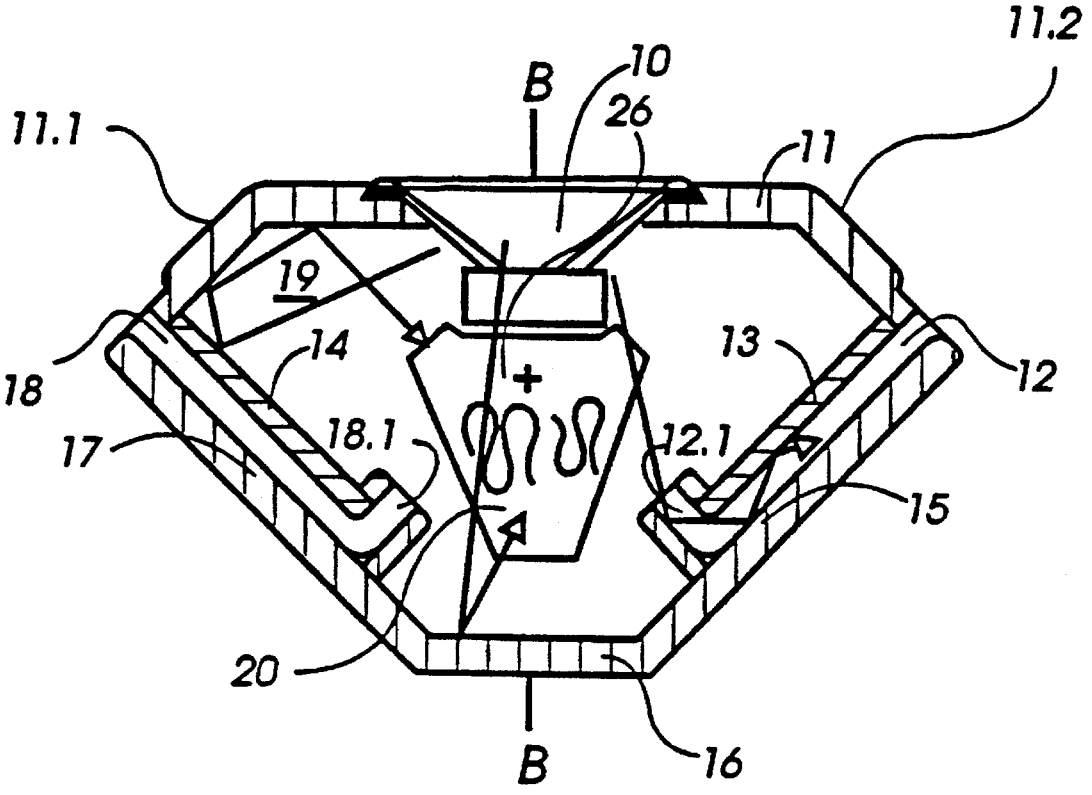
FIG. 5 is a transverse sectional view as in FIG. 2, showing sound wave reflections within a speaker according to the present invention.

Referring to FIG. 4(*a*) and particularly FIG. 5, it can be seen that back waves entering the vent inlet openings 12.1 and 18.1 will be deflected several times in the narrow, angled conduit, thereby sustaining considerable loss of energy and failing to escape the boundaries of the enclosure. Moreover, back waves that would normally escape through the woofer cone must travel twice through the centrally located absorbent material 20, again losing much energy in the process. (See arrow paths in FIG. 5).

The state of the air mass 19 in the enclosure is further altered by the thermal effects of the major portion of absorbent material 20 which is centrally located within the enclosure. Thus the interrelationship among driver, vent, absorbent material and air mass, as described, determines to a large extent the controlled behaviour of the air mass, and the improved low frequency performance of the system. The placement of the drivers on the baffle may be explained with reference to FIG. 1.

The woofer 10 is located near the bottom edge 11.4 of the panel, with its axis approximately 8 millimeters from a vertical center line of the baffle 11, while the tweeter 21 is positioned near the top edge 11.6 of the panel, with its axis about 80 millimeters from the vertical center line on the opposite side of the center line, as the woofer 10.

The woofer 10 is flush mounted on the slightly protruding baffle 11. This baffle protrusion, as well as the rounding of all baffle edges, effectively eliminates the problem of diffraction. The angular relationship between tweeter 21 and woofer 10 contributes to the final shape of the frequency response curve shown in FIG. 7. In a stereo arrangement, this helps to improve off-axis stereo imaging by introducing a small amount of attenuation in the tweeter nearer the listener, and conversely giving a slight advantage to the far tweeter. In addition, this baffle geometry also provides partial compensation for horizontal driver displacement in the on-axis listening situation. This occurs when each cabinet in a stereo pair is angled inward between 20 and 30 degrees, relative to the central listening position, and the acoustic center of each tweeter (which is normally forward of that of the woofer) is shifted backwards, and hence further away from the listener.

Figure 3:
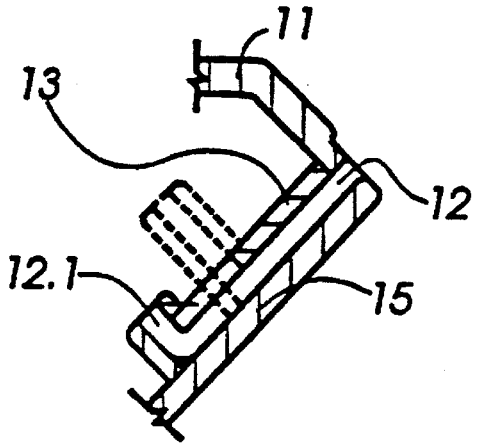
FIG. 3 is a partial view of the vent structure showing a method of establishing vent proportions of FIG. 2.

Referring back to FIG. 3, an illustration of the method employed in establishing the proportions of the long section 12 and the short section 12.1 (18, 18.1 ) is shown. Once the required length of the vent was established, the ratio between the long and short sections was varied until the best low frequency performance was obtained (see broken lines in the diagram). In the preferred embodiment, the ratio between short and long vent sections is approximately 1:6.

Referring back to FIG. 4(*a*), the horizontal center line of each vent is slightly above the central horizontal plane 23 of the enclosure 2, while the central axis of the woofer is substantially below the horizontal plane 23. The location of the covered-back tweeter 21 is indicated, and corner blocks 22 provide added structural rigidity to the enclosure.

The vents 12, 18, which are integrated with two of the larger cabinet panels 15, 17, serve three important functions. The first is to tune the enclosure for optimum low frequency response. The second function is to stiffen the panels to reduce panel resonance. The third, resulting from their narrow, angled design is to render the escape through them of antiphase back waves virtually impossible.

The procedures employed in tuning the enclosure are as follows:

Given the required enclosure volume ($v_B$), resonant frequency ($f_B$), and the desired cross-sectional area of the vent ($S_v$), vent length is established by applying the formula $$L_v/S_v=1.84\times10^8/\omega_b^2V_B \quad (1)$$

where L is the effective length of the vent in inches, S,, is given in square inches, and $V^B$ is in cubic inches. The variable $\omega_b=2\pi f_B$.

To calculate the necessary end correction for a vent with both ends flanged, the formula applied is $$(L_v/S_v)_{end}=0.958/\sqrt{S_v} \quad (2)$$

or, for a vent flanged at one end only, $$(L_v/S_v)_{end}=0.823/\sqrt{S_v} \quad (3)$$

While the vent length is calculated by applying the standard formulae above, the unique design of the vents, as well as the relationship among vent, driver, acoustic damping and air mass, makes it necessary to multiply the result by an empirically determined factor for more precise tuning. For example, significant improvement in low frequency performance was achieved when the result from applying equations (1) and (2) was corrected by a factor of 0.930. In the embodiment shown, the combined cross-sectional area of the twin vents is 8.5 square inches (54.84 $cm^2$), with the shortest dimension of one vent, that is, the distance from enclosure panel to vent panel being 9/16 inch (1.43 cm).

In a preferred embodiment utilizing a 1.06 $ft^3$ (30 L) enclosure, the equivalent diameter of the twin vents is 3.29 inches (8.35 cm). And as already mentioned, their internal terminations, together with the low frequency driver, are in a triangular arrangement (to which the hexagonal cabinet readily adapts itself). Vents 12, 18 and woofer 10 "fire" towards a region about the vertical axis 26 in the vicinity of the geometrical center of the enclosure.

It should be noted that the vents cannot be described as being entirely free-standing, since the greater proportion of each rum parallel to, and is integrated with, one of the wide back panels. These vents may best be regarded as combining features of both the double flanged and free-standing types.

The necessity for shortening the calculated length of the vents is consistent with the requirements for tuning an effectively larger enclosure to the same frequency. However, the increased resistance introduced by the vent angle and cross-sectional proportions may also be contributing factors. To what extent this may be the case could not be determined by the techniques I employed. What was established is that in the preferred embodiment, increasing the density of the column of absorbent material installed about the center of the enclosure lowered $f_B$ by as much as 6%, or to state it differently, required a reduction in vent length to hold $f_B$ constant. Fiberglass was the absorbent material chosen, and the quantity applied was in the order of 80 to 100 grams.

Tweeter position was established empirically by mounting the tweeter eccentrically on a circular, adjustable sub-baffle on a prototype enclosure. Rotation of the sub-baffle permitted various anechoic frequency response measurements to be taken with the tweeter in different positions, relative to the woofer. The most desirable response was obtained in this way.

The system derives further advantages from the irregular shape of the enclosure 2, which renders the propagation of standing waves between any two vertical panels virtually impossible. Such waves will also lose energy when passing through the absorbent material 20.

To deal with the special case of standing waves between the top panel 7 and bottom panel 28, which are parallel to each other, small additional pieces of absorbent material 25 are disposed horizontally, approximately midway around the central absorbent column 20 as shown in FIG. 4(*b*). A further refinement is that density and thickness differences in the top and bottom panels distribute their natural vibration periods and reduce the chance of their being excited at the same frequency.

The top panel 27 and large back panels 15, 17 are made of 17.5 millimeter veneered particle board, while the bottom panel 28, baffle 11 and small back panel 16 are of 19 millimeter high density particle board. The vents are made of 9.5 millimeter plywood and solid wood. Bracing is applied to all 17.5 millimeter material, and inside surfaces of the enclosure are treated with bituminous damping material.

The invention makes possible the use of vents of relatively large cross sectional area in small enclosures. This is often difficult to realize in conventional designs, since vents large enough to avoid turbulence and the generation of spurious sounds tend to be long and, in the case of those originating from the front baffle, "fire" internally towards the very regions where pressures are highest. In the present design, vent orientation away from regions of highest pressure overcomes this problem. In fact, internal box conditions are effectively exploited to enhance performance at low frequencies.

The system as a whole provides several other advantages. One is that the non-rectangular shape of the enclosure is inherently anti-resonant, to the extent that standing waves cannot develop between opposite side walls whose varied sizes in addition, distribute their natural vibration periods. A second advantage is that antiphase back waves which emanate from conventional vents located on the front baffle will have difficulty escaping the narrow rectangular vents of the present design, since they would have to negotiate the angle of the vents and would in any case lose energy in bouncing between vent panels. In addition, the triangular woofer-vent configuration about the air mass inside the enclosure largely accounts for the controlled behaviour of the air mass. In a narrow sense, this is analogous to the stable behaviour of an inflated balloon of reasonable size held between the fingers of both hands and squeezed at intervals, compared to the behaviour of the same balloon held with one hand and squeezed in a similar way.

Other refinements of the system preserve the advantages gained from the internal features already described. For example, the baffle's projection and rounded edges eliminate virtually all traces of diffraction. And as mentioned above, the angled position of the tweeter, relative to the woofer, enhances the stereo effect, permitting full stereo enjoyment even when the listener is sitting off axis and quite close to one of the enclosures in a stereo pair.

It is noted that the tweeter is of a closed-back type that will not normally be affected by the pressure changes or reflected waves inside the enclosure.

Figure 6:
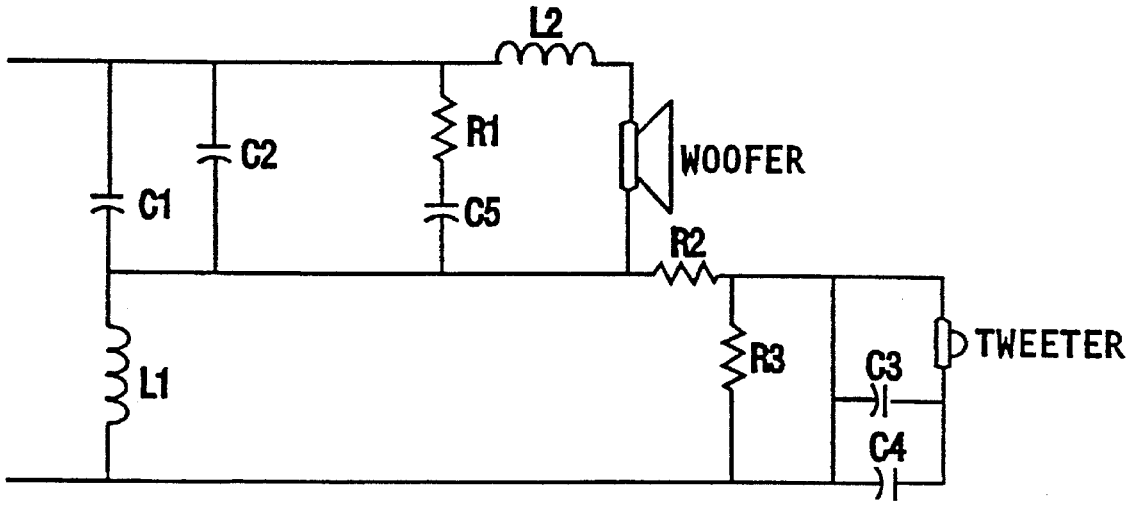
FIG. 6 is a schematic diagram of a crossover network.

It is understood that the drivers are to be properly connected to a suitably designed crossover network that serves the crossover function, adjusts the system impedance dynamically, and establishes desirable phase relationships over the system frequency range. The crossover network in turn links the loudspeaker system to the amplifier output. FIG. 6 is a diagram of a Butterworth crossover network used in the subject design. A filter network of this type is well known in the art.

Figure 7:
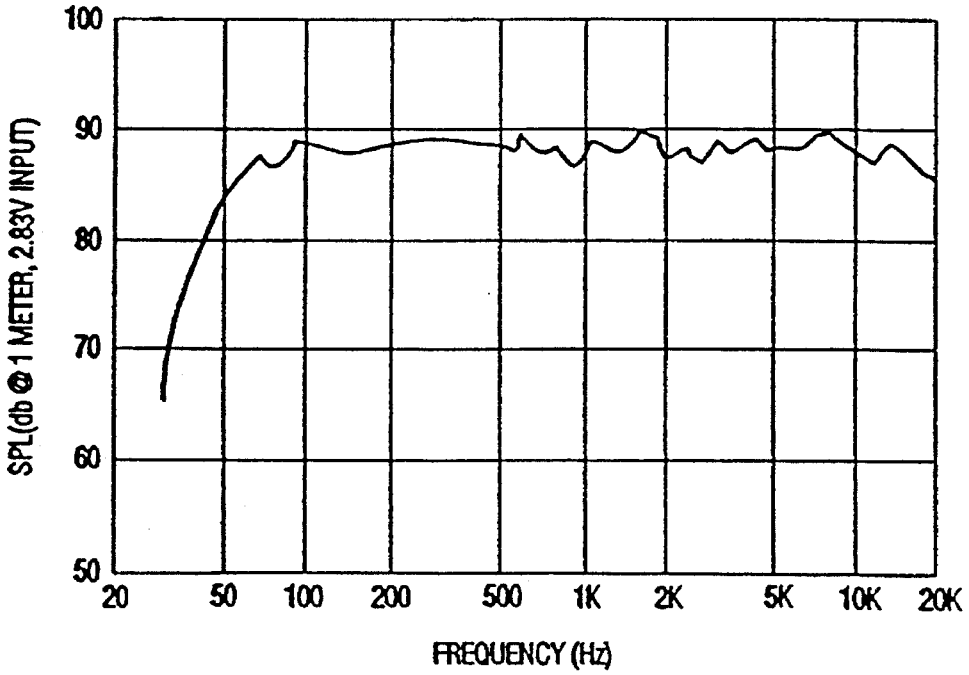
FIG. 7 is a plot of a frequency response of a speaker according to the present invention.

While the unique vent-driver configuration is a principal feature of this invention, the cumulative benefits of other features of the system need to be appreciated as well. The overall sonic advantages are improved low frequency performance, remarkable spatial imaging, high sensitivity (89 decibels anechoic), and exceptional clarity over the system's frequency range. This remains true even at high sound pressure levels, relative to system size. The on axis frequency response (anechoic) for an input of 1 watt (2.83 V RMS) @1 meter is shown in FIG. 7.

But although the angles and other dimensions stated in this disclosure concern the preferred embodiment, it is conceivable that persons knowledgeable in the field can, within the framework of the overall concept, modify certain dimensions and relationships to some extent, without significantly degrading the reproduced sound. What is particularly significant, though, is the comprehensive integration of important features that contribute to the superior sonic quality of the system. Box shape and the deployment of materials, vent design and location, placement of absorbent material, driver-vent-air mass relationship and baffle configuration are all advantageously integrated in this system.

While the invention has been described in connection with a specific embodiment thereof and in a specific use, various modifications thereof will occur to those skilled in the art without departing from the spirit and scope of the invention as set forth in the appended claims.

The terms and expressions which have been employed in the specification are used as terms of description and not of limitations, and there is no intention in the use of such terms and expressions to exclude any equivalents of the features shown and described or portions thereof, but it is recognized that various modifications are possible within the scope of the claims to the invention.

The embodiments of the invention in which an exclusive property or privilege is claimed are defined as follows:

1. A loudspeaker system comprising:

a loudspeaker driver;

an enclosure having a hexagonal prism shape generally defined by a front baffle, a first baffle extension and a second baffle extension, a top and bottom panel, a pair of major panels and a rear panel, said baffle extension being substantially equal to each other and arranged at each side of said front baffle and forming a first angle with respect to said front baffle.

said major panels being substantially equal to each other and each arranged at each side of said rear panel at a second angle with respect to said rear panel;

vent means in said enclosure, comprising a first and a second vent, each vent having, respectively, an inlet within said enclosure, an outlet leading outside the boundaries of said enclosure, and a conduit connecting each said inlet to its associated said outlet, wherein said outlet of said first vent is provided adjacent to said first baffle extension and said outlet of said second vent is provided adjacent to said second baffle extension, each of said conduits being arranged along the inner face of a respective one of said major panels and said inlets being directed toward the rear of said driver and generally toward a central region of said enclosure such that high to mid frequency sound waves radiated within the boundaries of said enclosure and entering said inlets are substantially attenuated in said conduits and low frequency sound waves radiated within the boundaries of said enclosure are reinforced.

2. A speaker system as defined in claim 1, said inlet being a pair of inlet openings each opening of each vent extending generally transverse to its associate conduit, such that a central axis of each of said inlet openings intersect with each other and with an approximate vertical central axis of said enclosure in a central point of said enclosure.

3. A loudspeaker system as defined in claim 1, further including a prism shaped body of sound absorbent material positioned between said top and bottom panels and substantially on an approximate vertical central axis of said enclosure.

4. A loudspeaker system as defined in claim 3, further comprising a pair of small pieces of sound absorbent material disposed horizontally, approximately midway around said prism-shaped body of sound absorbent material.

5. A loudspeaker system as defined in claims 1, said first angles of said extensions being approximately 45°.

6. A loudspeaker system as claimed in claim 1, further including a high frequency driver.

7. A loudspeaker system as defined in claim 6, said high frequency driver being of a closed back type.

8. A loudspeaker system as claimed in claim 6, wherein said loudspeaker driver is located near the bottom edge of said baffle with its axis at approximately 8 mm from the vertical centre line of said baffle, and said high frequency driver is positioned near the top edge of said baffle with its axis at approximately 80 mm from the vertical centre line of said baffle, on the opposite side of the vertical centre line from said loudspeaker driver.

9. A loudspeaker system as claimed in claim 1, wherein for an enclosure of 30 liters, the equivalent diameter of said vent conduits is 8.35 cm and the combined cross-sectional area of the twin vents is 54.84 $cm^2$ with said inlet having a width of 1.43 cm.

10. A loudspeaker system as claimed in claim 1, wherein said conduit is defined between a section of said major panel and a wail parallel with said major panel and fixed to an edge of said baffle extension to form said outlet between said baffle extension and said major panel, and wherein said inlet is formed by two inserts perpendicular on said major panel and said wall, respectively.

11. A loudspeaker system as defined in claim 10, wherein the ratio between the length of said conduit and said inlet is 1:6.

12. A loudspeaker system comprising:

a loudspeaker driver having a front and a rear;

an enclosure having a hexagonal prism shape, with a front baffle provided with means receiving and supporting said loudspeaker driver therein; and vent means in said enclosure, said vent means comprising a first and a second vent, each vent including an inlet opening within said enclosure and directed generally toward the rear of said loudspeaker driver, an outlet opening leading outside the boundaries of said enclosure, and a conduit connecting said inlet opening to said outlet opening, wherein a central axis of each of said inlets intersect with each other and with an approximate vertical central axis of said enclosure in a central point:

said vents being sized such that high to mid frequency sound waves radiated within the boundaries of said enclosure and entering each of said inlets are substantially attenuated in said conduit and low frequency sound waves radiated within the boundaries of said enclosure are reinforced.

13. A loudspeaker system as defined in claim 12, said enclosure being defined by said front baffle, a first and a second baffle extension, a top and a bottom panel, a pair of major panels and a rear panel, being substantially equal to each other and arranged respectively at each side of said rear panel at a second angle with respect to said rear panel.

14. A loudspeaker system as defined in claim 13, wherein said conduits each extends along the inner surface of a respective one of said major panels between the inlet and outlet openings associated therewith.

15. A loudspeaker system as defined in claim 13, wherein said top panel and said major panels are made of a first material while said bottom panel, said baffle, said extensions and said back panel are made of a second material.

16. A loudspeaker system as defined in claim 12, wherein each of said inlet openings extends generally transverse to its associate conduit.

17. A loudspeaker system as defined in claim 16, further including a prism-Shaped body Of sound absorbent material positioned between said top and bottom panels and substantially on a vertical central axis of said enclosure.

18. A loudspeaker system as defined in claim 17, wherein said baffle further includes means for receiving and supporting a high frequency driver.

19. A loudspeaker system as defined in claim 12, said first angles of said extensions being approximately 45° relative to said front baffle.

20. A loudspeaker system comprising:

a loudspeaker driver;

an enclosure having a hexagonal prism shape, with a front baffle provided with means receiving and supporting said loudspeaker driver therein;

a pair of vent means in said enclosure, said vent means comprising a first and a second vent each vent having a vent inlet within said enclosure and directed generally toward the rear of said driver, a vent outlet opening leading outside the boundaries of said enclosure, and a conduit connecting said vent inlet opening to said vent outlet, wherein the vent inlets of said vent means each extend at an angle to their respectively associated conduits, such that the central axes defined by said vent inlets intersect at an approximately vertical central axis of said enclosure, and the vent outlets of said vent means being disposed at respective opposing sides of said front baffle.

21. A loudspeaker system as defined in claim 20, said enclosure being defined by said front baffle, a first and a second baffle extension, a top and a bottom panel, a pair of major panels and a rear panel, said baffle extensions being substantially equal to each other and arranged at each side of said front baffle at a first angle with respect to said front baffle, said major panels being substantially equal to each other and arranged respectively at, each side of said rear panel at a second angle with respect to said rear panel.

22. A loudspeaker system as defined in claim 21, wherein said vent outlets are each positioned at a respective juncture between said baffle extension and said major panel, and said conduits each being attached to and extending along the inner surface of a respective one of said major panels.

23. A loudspeaker system as defined in claim 21, further including a prism-shaped sound absorbent material positioned between said top and said bottom panels and substantially on an approximate vertical central axis of said enclosure.

24. A loudspeaker as defined in claim 20, said angles of said extensions being approximately 45° with respect to said front baffle.

* * * * *

UNITED STATES PATENT AND TRADEMARK OFFICE

CERTIFICATE OF CORRECTION

PATENT NO. : 5,513,270

DATED : April 30, 1996

INVENTOR(S) : Leopold A. Lewis

It is certified that error appears in the above-indentified patent and that said Letters Patent is hereby corrected as shown below:

On title page, item

[87] "WO93/04564" should be --WO93/04565--

Column 9, line 10, after "panel," insert --said baffle extensions being substantially equal to each other and arranged at each side of said front baffle at a first angle with respect to said front baffle, said major panels--

Signed and Sealed this

Twenty-third Day of July, 1996

Bruce Lehman

*Attest:*

BRUCE LEHMAN

*Attesting Officer*

*Commissioner of Patents and Trademarks*